US006788277B2

(12) United States Patent
Kanauchi et al.

(10) Patent No.: US 6,788,277 B2
(45) Date of Patent: Sep. 7, 2004

(54) DRIVE UNIT AND DRIVE METHOD OF LIGHT-EMITTING DISPLAY PANEL

(75) Inventors: Katsuhiro Kanauchi, Yonezawa (JP); Shuichi Seki, Yonezawa (JP)

(73) Assignee: Tohoku Pioneer Corporation, Tendo (JP)

( * ) Notice: Subject to any disclaimer, the term of this patent is extended or adjusted under 35 U.S.C. 154(b) by 0 days.

(21) Appl. No.: 10/259,637

(22) Filed: Sep. 30, 2002

(65) Prior Publication Data

US 2003/0197472 A1 Oct. 23, 2003

(30) Foreign Application Priority Data

Apr. 23, 2002 (JP) ..... 2002-120405

(51) Int. Cl.[7] ..... G09G 3/30; G09G 3/10

(52) U.S. Cl. ..... 345/77; 345/82; 345/87; 345/100; 315/169.2

(58) Field of Search ..... 345/77, 76, 82, 345/87, 88, 90, 98, 100, 55, 60, 61, 63, 74; 315/169.2, 169.3

(56) References Cited

U.S. PATENT DOCUMENTS

2002/0135556 A1 * 9/2002 Nakajima et al. ..... 345/98

2002/0175887 A1 * 11/2002 Yamazaki ..... 345/87

OTHER PUBLICATIONS

Patent Abstracts of Japan, Publication No. 09–232074, dated Sep. 5, 1997.

* cited by examiner

*Primary Examiner*—Tuyet T. Vo
(74) *Attorney, Agent, or Firm*—Westerman, Hattori, Daniels & Adrian, LLP

(57) ABSTRACT

Power saving is more realized when a partial display is executed in active matrix type EL display elements.

When the partial display is executed, a scan driver 2 repeatedly scans all the scan lines as executed ordinarily. In contrast, when a scan shifts from a display region to a non-display region, black display data is captured by a shift resister $\mathbf{1}_a$ in a data driver 1 for one horizontal period and latched by a latch circuit $\mathbf{1}_b$. Then, while the non-display region is being scanned, the drive of the data driver 1 is stopped. Accordingly, in the scan of the non-display region, a non-display state is achieved by the black display data latched by the latch circuit $\mathbf{1}_b$. Low power consumption can be realized because the drive of the data driver 1 operating at a high speed is stopped while the non-display region is being scanned.

20 Claims, 10 Drawing Sheets

【Fig.1】
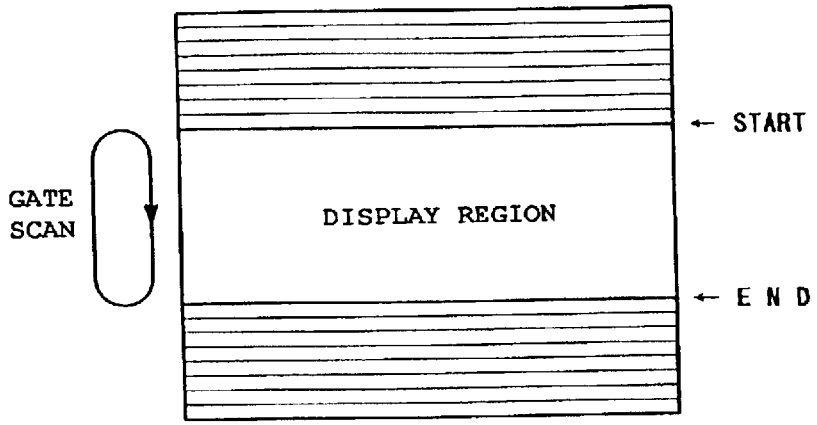
【Fig.2】
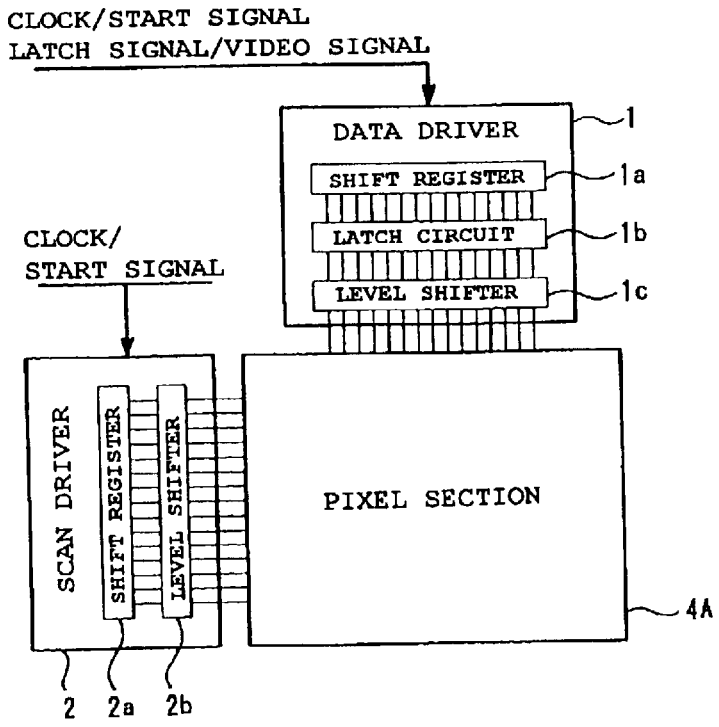

【Fig.3】
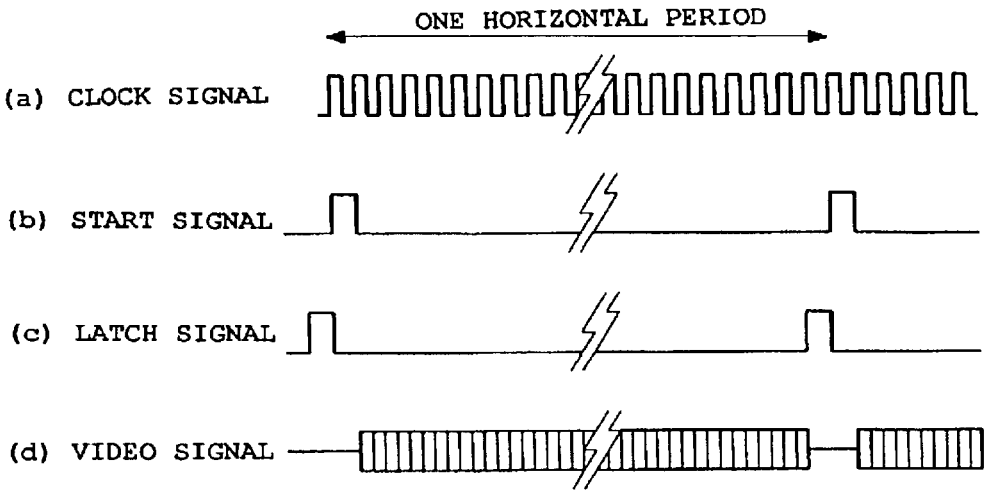
【Fig.4】
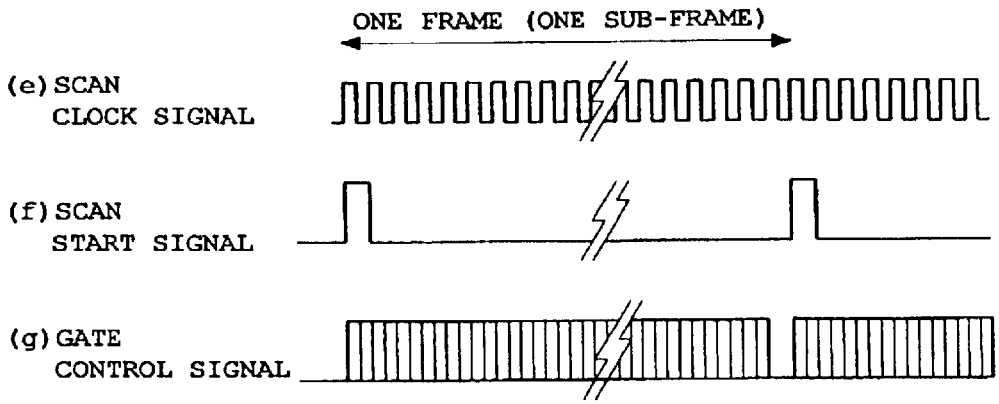

【Fig.5】
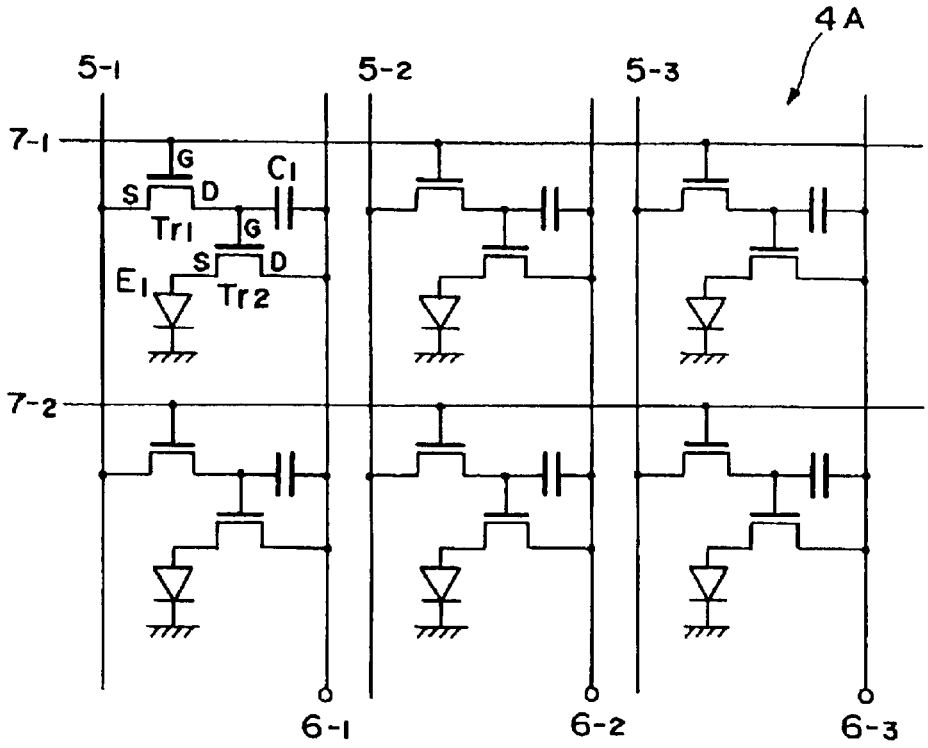

【Fig.6】
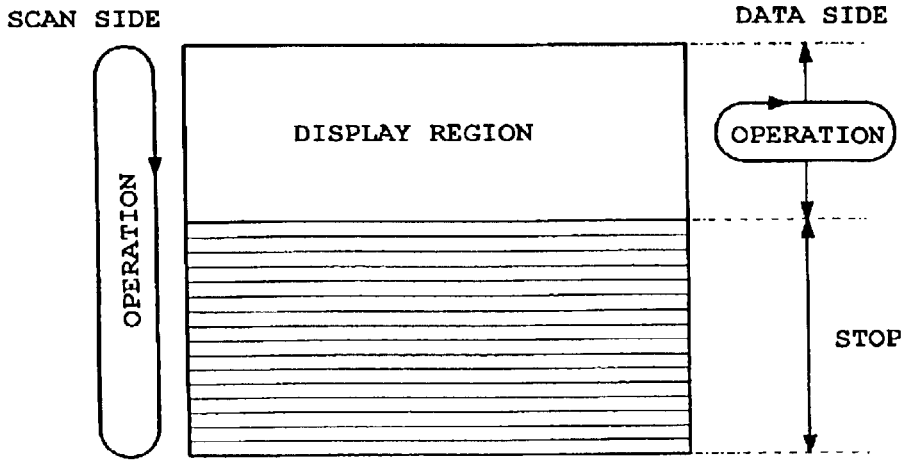

【Fig.7】
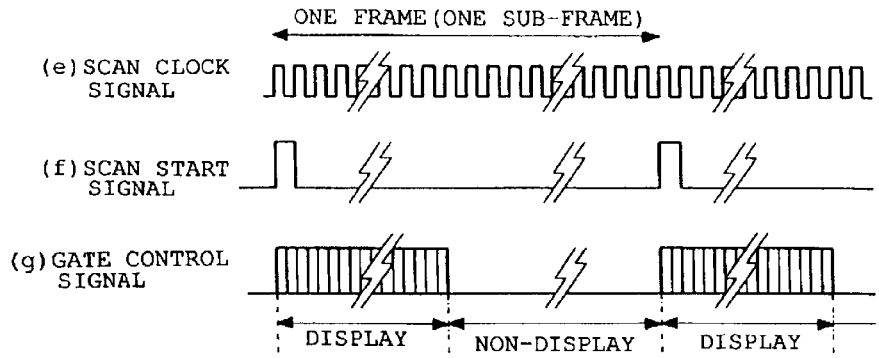
【Fig.8】
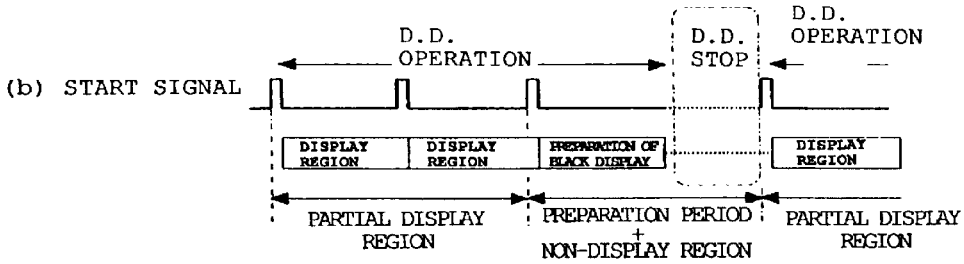
【Fig.9】
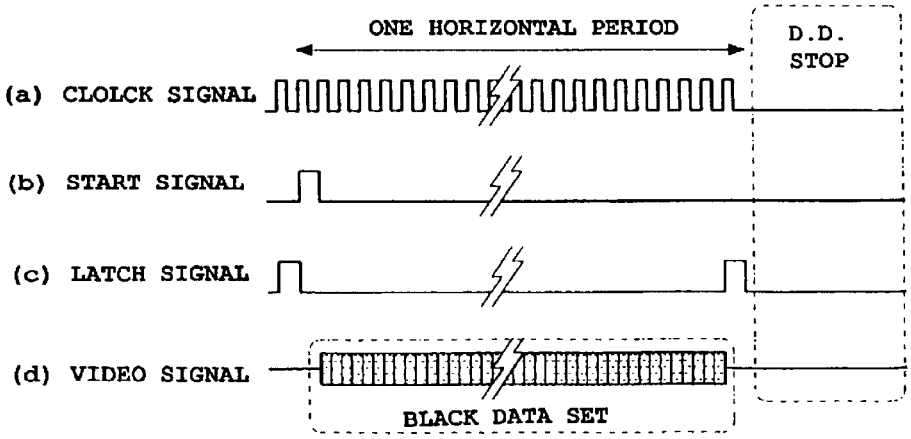

【Fig.10】
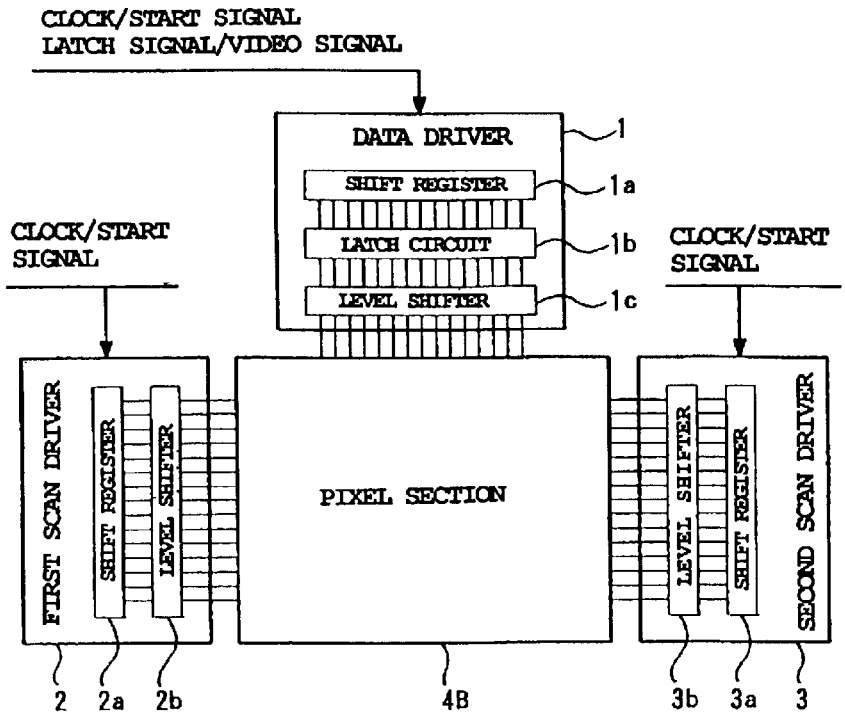

【Fig.11】
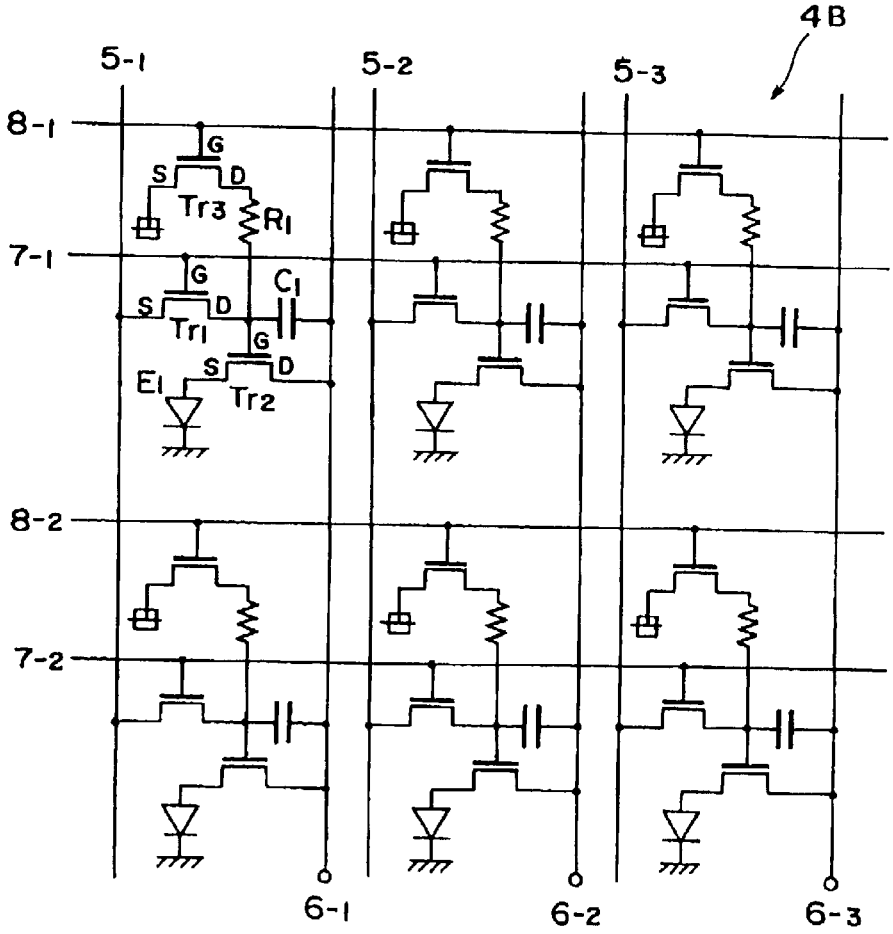

【Fig.12】
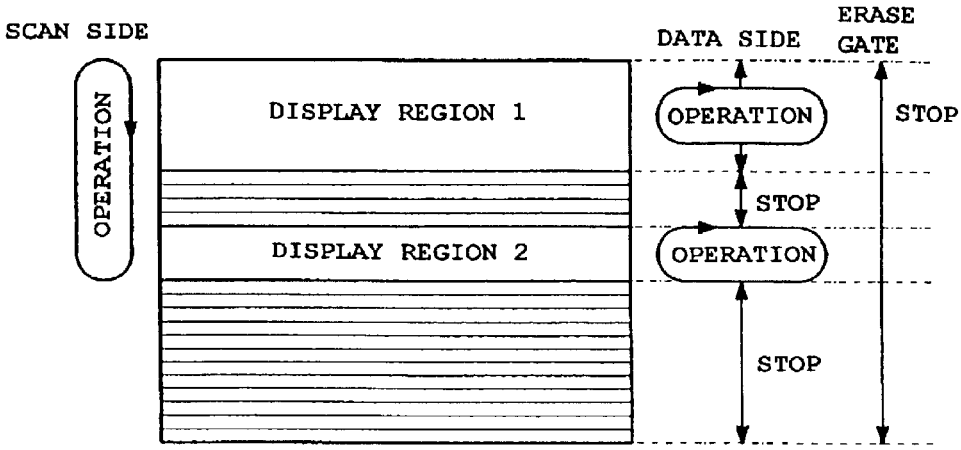

【Fig.13】
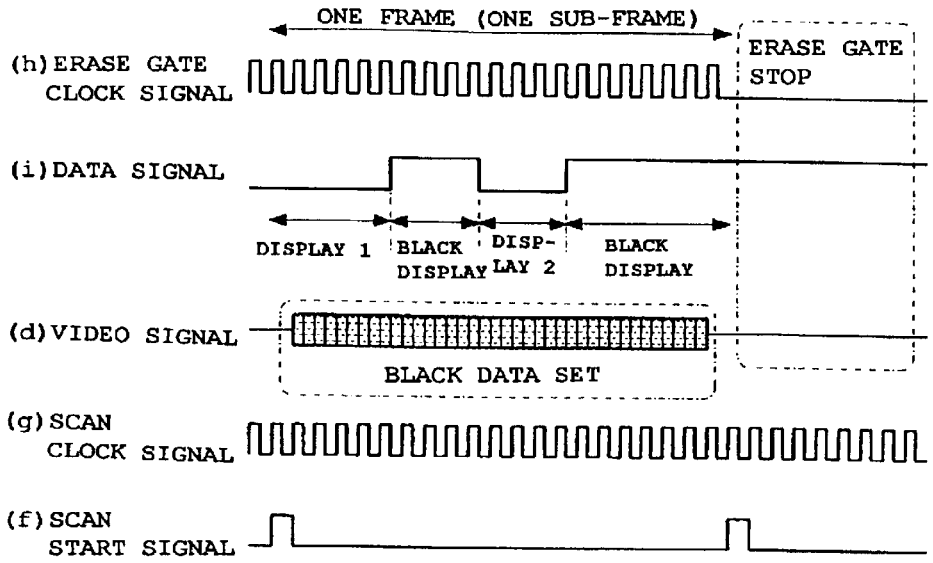
【Fig.14】
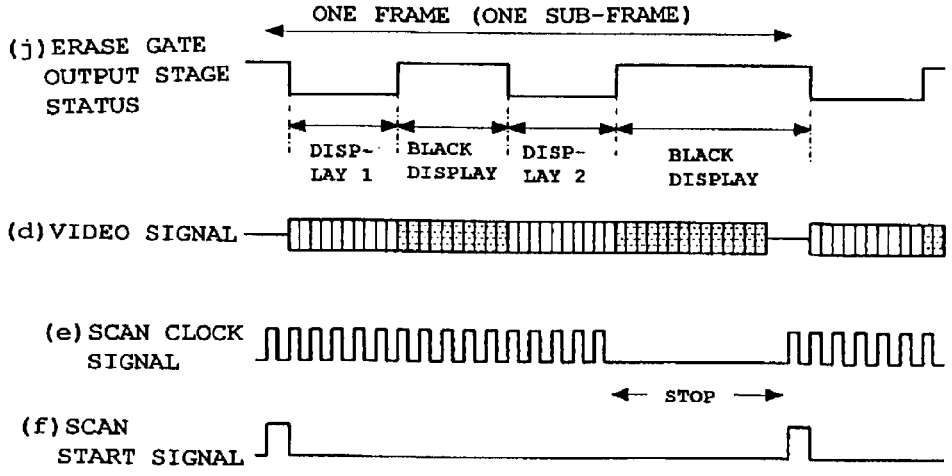

【Fig.15】
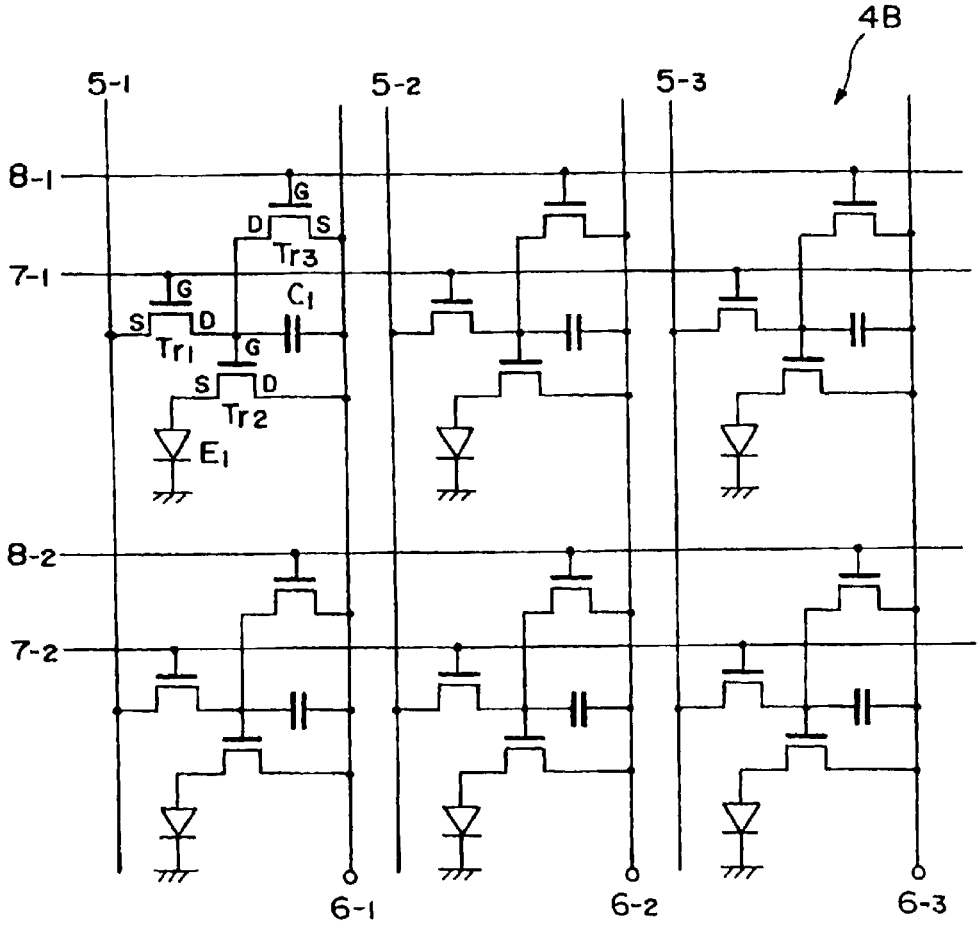

DRIVE UNIT AND DRIVE METHOD OF LIGHT-EMITTING DISPLAY PANEL

BACKGROUND OF THE INVENTION

1. Field of the Invention

The present invention relates to a drive unit of a display panel for active driving light-emitting elements constituting pixels, and more particularly, to a drive unit and a drive method of a light-emitting display panel for realizing low power consumption by selecting a partial display mode for controlling light emission making use of a part of the effective light-emitting elements disposed in a display panel.

2. Description of the Related Art

Displays using a display panel composed of light-emitting elements disposed in a matrix shape are under extensive development. Attention is given to organic electroluminescence (EL) elements using, for example, an organic material in the light emitting layers thereof as the light-emitting elements used in the display panel. This is because the efficiency and life of the organic display panel have been improved to a practically usable level by using an organic compound promising good light emitting characteristics in the light-emitting layers of the EL elements.

There have been proposed, as the display panel using the organic EL elements, a simple matrix type display panel in which EL elements are simply disposed in a matrix shape and an active matrix type display panel in which drive elements composed of, for example, TFTs (Thin Film Transistors) are added to the respective EL elements disposed in the matrix shape. The latter active matrix type display panel is suitable for a high-definition display because the latter display panel has such characteristics that it can realize lower power consumption than the former simple matrix type display panel and that it has a less amount of crosstalk between pixels.

In particular, nowadays, the application of the self-emitting type displays described above to hand-held type terminal equipment, and the like, which are typically represented by portable phones, has been partly realized, and the equipment more and more requires low power consumption. To realize the low power consumption, it is effective, in an example of, for example, the portable phones, to select a partial display mode for controlling light emission making use of only a part of the effective light-emitting elements of a display in a waiting mode.

Incidentally, in the active matrix type display panel described above, a data driver and a scan driver are designed so as to be arranged on, for example, a glass substrate, on which a display pixel section is formed, so that the number of signal lines connected between the display panel and external circuits is reduced as much as possible. When it is intended to realize the partial display described above in the above circumstances, it is necessary to add a partial drive circuit to the scan driver.

FIG. 1 schematically shows an example of a display screen, in which a display region is formed, for example, between a scan start position (START) and a scan end position (END), when the partial display is executed. When the partial display is executed, it is necessary to input a start signal at the START position and to clear a shift register in the scan driver at the END position.

To permit a scan to be started from an arbitrary line on an effective display screen as shown in FIG. 1, a register for setting a scan start position, a decoder for enabling the value of the register to respective scan lines, and the like are necessary. When it is assumed that the total number of the scan lines is, for example, 240, a decoder for making conversion from 8 bits to 240 bits is necessary, and the scale of the decoder is made very large. Further, gates and the wirings thereof are necessary to reset the shift resister.

When the wirings described above are added to the active matrix type display panel, it is anticipated that the number of TFTs constituting the scan driver will be at least quadrupled. According to this arrangement, it is contemplated that the ratio of the glass substrate occupied by the scan driver increases from, for example, 5% to 20%. As a result, an active area is forced to be reduced by about 15% and thus an opening ratio is reduced, which requires to increase the instant luminance of light-emitting elements in order to obtain predetermined luminance.

Accordingly, when it is intended to realize the partial drive in the conventional active matrix type display panel, there is a technical problem in that low power consumption cannot be realized as a whole due to an increase in the electric power consumed by the circuits added as described above and to an increase in the electric power consumed to increase the instant luminance of the EL elements.

SUMMARY OF THE INVENTION

An object of the present invention, which was made based on the technical point of view described above, is to provide a drive unit and a drive method of a light-emitting display panel capable of realizing a partial drive without the addition of a complex control circuit added thereto and reducing power consumption thereby in an active matrix type display panel in which a data driver and a scan driver are arranged on the same substrate constituting the display panel.

In a drive unit of an active matrix type display panel according to a first embodiment of the present invention, which was made to solve the problems described above, having a plurality of light-emitting elements which are disposed at the intersecting positions where a plurality of data electrode lines and a plurality of scan electrode lines intersect and the light emission of which is controlled by drive circuits, respectively, the drive unit is characterized by including a data driver for supplying image data to the respective data electrode lines, a scan driver for sequentially supplying a scan signal to the respective scan electrode lines, and control means for stopping the operation of the data driver when a partial display drive for controlling the light emission of a part of the effective light-emitting elements in the display panel is executed and when the scan driver scans a non-display region.

In this case, it is preferable that the data driver and the scan driver be disposed on the same substrate constituting the display panel together with the respective drive circuits and the respective light-emitting elements corresponding thereto. Further, the drive circuits are preferably composed of control transistors for transmitting image data supplied from the data driver based on a scan signal supplied from the scan driver and drive transistors for supplying a drive current to the light-emitting elements based on the image data transmitted by the control transistors.

Then, in a preferable embodiment, the data driver may include a shift register for capturing serial image data as parallel image data by sequentially shifting up the serial image data based on a clock signal and a latch circuit for outputting pixel unit image data to the respective data electrode lines by latching the image data captured by the shift resister based on a latch signal. Further, the scan driver may include a shift register for outputting a scan signal to the respective scan electrode lines by sequentially shifting up it based on a clock signal.

Then, it is preferable that the drive unit include a black data set means for capturing black data for controlling the light-emitting elements in a non-lighting state for at least one horizontal period when a scan is executed from a display region to a non-display region while the partial display drive is being executed to control the light emission of a part of the effective light-emitting elements in the display panel.

In contrast, in a drive method of the active matrix type display panel according to the first embodiment of the present invention having a plurality of light-emitting elements which are disposed at the intersecting positions where a plurality of data electrode lines and a plurality of scan electrode lines intersect and the light emission of which is controlled by drive circuits, respectively, a data driver for supplying image data to the respective data electrode lines, and a scan driver for sequentially supplying a scan signal to the respective scan electrode lines, the drive method executes a black data set step of capturing black data for controlling the light-emitting elements in a non-lighting state for at least one horizontal period when a scan is executed from a display region to a non-display region while a partial display drive is being executed to control the light emission of a part of the effective light-emitting elements in the display panel, and a step of scanning the non-display region with the scan signal from the scan driver in a black data set state that is set by the data driver.

In this case, it is preferable that the supply of a clock signal for driving the data driver be stopped while the step of scanning the non-display region is being executed.

According to the drive unit of the first embodiment of the present invention employing the drive method described above, when an ordinary display drive or a partial display expressed as a partial display drive is executed, the scan driver continues a state in which one frame (or one sub-frame) is sequentially scanned at all times based on a scan start signal. Then, when the non-display region is scanned by executing the partial display, the drive of the data driver is stopped. This is executed by, for example, stopping the clock signal supplied to the data driver.

As described above, since the data driver that operates at a high speed is temporarily stopped when the non-display region is scanned, low power consumption can be realized. Thus, when the width of the display region is small with respect to a scan direction, low power consumption characteristics can be obtained accordingly.

In contrast, in a drive unit of an active matrix type light-emitting display panel according to a second embodiment of the present invention having a plurality of light-emitting elements which are disposed at the intersecting positions where a plurality of data electrode lines, a plurality of scan electrode lines, and a plurality of erase electrode lines intersect and the light emission of which is controlled by drive circuits, respectively, the drive unit is characterized by including a data driver for supplying image data to the respective data electrode lines, a first scan driver for sequentially supplying a scan signal to the respective scan electrode lines, a second scan driver for supplying an erase signal to the erase electrode lines, and control means for stopping the operation of the data driver when a partial display drive for controlling the light emission of a part of the effective light-emitting elements in the display panel is executed and when the first scan driver scans a non-display region as well as for forcibly extinguishing the light-emitting elements corresponding to the non-display region by supplying an erase signal to the erase electrode lines corresponding to the non-display region from the second scan driver.

In this case, it is preferable that the data driver, the first scan river, and the second scan driver be disposed on the same substrate constituting the display panel together with the respective drive circuits and the respective light-emitting elements corresponding thereto. Further, the drive circuits are preferably composed of control transistors for transmitting image data supplied from the data driver based on the scan signal supplied from the first scan driver, drive transistors for supplying a drive current to the light-emitting elements based on the image data transmitted by the control transistors, and erase transistors for disabling the operation of the drive transistors based on the erase signal supplied from the second scan driver.

In a preferable embodiment, the second scan driver may include a shift resister to which erase control data corresponding to a partial display pattern is set based on a clock signal. Then, it is preferable that the erase control data corresponding to the partial display pattern be set to the shift resister in the second scan driver during a preparation frame period.

In addition, it is preferable that black data for controlling the light-emitting elements in a non-lighting state be captured by the shift resister in the data driver during the preparation frame period. Further, it is preferable that the first scan driver be arranged to stop its operation during a period until the starting point of a next one frame or one sub-frame is scanned after the first scan driver has scanned the final display region of one frame or one sub-frame.

In any arrangement of the first and second embodiments described above, it is preferable that the light-emitting elements be composed of organic EL elements using an organic compound in the light emitting layers thereof.

In contrast, in a drive method of an active matrix type display panel according to the second embodiment of the present invention having a plurality of light-emitting elements which are disposed at the intersecting positions where a plurality of data electrode lines, a plurality of scan electrode lines, and a plurality of erase electrode lines intersect and the light emission of which is controlled by drive circuits, respectively, a data driver for supplying image data to the respective data electrode lines, a first scan driver for supplying a scan signal to the respective scan electrode lines, and a second scan driver for supplying an erase signal based on a partial display pattern to the respective erase electrode lines, the drive method executes a step of setting the erase data based on the partial display pattern to the second scan driver, a step of executing a partial display based on the image data supplied from the data driver when a display region is scanned with the scan signal from the first scan driver, and a step of forcibly extinguishing the light-emitting elements corresponding to a non-display region based on the erase data set to the second scan driver when a scan is executed from the display region to the non-display region.

In this case, it is preferable that the drive of the data driver be stopped as well as that the first scan driver stop its operation during a period until the starting point of a next one frame or one sub-frame is scanned after the first scan driver has scanned the final display region of one frame or one sub-frame in the state in which the non-scan region is scanned. In addition, it is preferable that a step of capturing black data for controlling the light-emitting elements in a non-lighting state by the shift resister in the data driver be executed just before a step of setting the erase data based on the partial display pattern to the second scan driver is executed.

According to the drive unit of the second embodiment of the present invention employing the drive method described above, when the partial display expressed as the partial display drive is executed and the non-display region is scanned, the drive of the data driver is stopped similarly to the drive unit of the first embodiment described above. This is executed by, for example, stopping the clock signal supplied to the data driver. Thus, low power consumption can be realized because the data driver operating at a high speed is temporarily stopped.

Further, according to the drive unit of the second embodiment of the present invention, the first scan driver can stop its operation during a period until the starting point of a next one frame or one sub-frame is scanned after the first scan driver has scanned the final display region of one frame or one sub-frame. This is because the erase data based on the partial display pattern is preset to the second scan driver and the light-emitting elements corresponding to the non-display portion are forcibly extinguished thereby. Thus, according to the drive unit of the second embodiment, lower power consumption can be realized because the first scan driver can be also stopped in a non-display period of time.

BRIEF DESCRIPTION OF THE DRAWINGS

FIG. 1 is a schematic view of a display screen explaining a problem when a partial display is realized;

FIG. 2 is a block diagram showing a first embodiment of a drive unit according to the present invention;

FIG. 3 is a timing chart of respective signals supplied to a data driver in the drive unit shown in FIG. 2;

FIG. 4 is a timing chart of respective signals supplied to a scan driver in the drive unit shown in FIG. 2;

FIG. 5 is a wiring diagram showing an example of the arrangement a pixel section in the drive unit shown in FIG. 2;

FIG. 6 is a schematic view of a display screen showing an example of a partial display executed by the first embodiment;

FIG. 7 is a timing chart of respective signals supplied to a scan driver used in the partial display executed by the first embodiment;

FIG. 8 is a timing chart explaining operation when a scan is made from a display region to a non-display region in the partial display;

FIG. 9 is a timing chart showing operation during a black preparation period shown in FIG. 8;

FIG. 10 is a block diagram showing a second embodiment of the drive unit according to the present invention;

FIG. 11 is a wiring diagram showing an example of the arrangement example of a pixel section in the drive unit shown in FIG. 10;

FIG. 12 is a schematic view of a display screen showing an example of a partial display executed by the second embodiment;

FIG. 13 is a timing chart explaining operation for inserting a scan side preparation frame performed when the partial display is executed by the second embodiment;

FIG. 14 is a timing chart mainly explaining scan side operation performed when the partial display is executed by the second embodiment; and FIG. 15 is a wiring diagram showing other example of the arrangement of the pixel section in the drive unit shown in FIG. 10.

DESCRIPTION OF THE PREFERRED EMBODIMENTS

Embodiments according to the present invention will be described below based on the drawings. FIG. 2 shows a first embodiment of a drive unit of an active drive type display panel according to the present invention. In the first embodiment, the drive unit of the active matrix type display panel includes a data driver 1 and a scan driver 2 which are mounted on, for example, the same glass substrate (not shown), which constitutes the display panel, together with a pixel section 4A.

A clock signal, a start signal, and a latch signal as well as a video signal, and the like are supplied to the data driver 1 from an external circuit. Further, a scan clock signal, a scan start signal, and the like are supplied to the scan driver 2 from the external circuit in the same manner. With this arrangement, the number of wirings between the data driver 1 disposed on, for example, the glass substrate constituting the display panel and the external circuit and the number of wirings between the scan driver 2 and the external circuit can be reduced as much as possible.

The data driver 1 includes a shift register $\mathbf{1}_a$, a latch circuit $\mathbf{1}_b$, and a level shifter $\mathbf{1}_c$. As shown in FIG. 3, when the data driver 1 receives a start signal (b) in synchronism with a clock signal (a), the shift register $\mathbf{1}_a$ captures a video signal (d) acting as a serial image data for one horizontal period as parallel data according to a clock signal (a), the latch circuit $\mathbf{1}_b$ latches the video signal for the one horizontal period from the shift register $\mathbf{1}_a$ at a time based on a latch signal (c) that is output at the time the one horizontal period has been completed, and the level shifter $\mathbf{1}_c$ outputs the video signal having been latched by the latch circuit $\mathbf{1}_b$ to the pixel section 4A after it has been converted into a predetermined level.

In contrast, the scan driver 2 includes a shift register $\mathbf{2}_a$ and a level shifter $\mathbf{2}_b$. As shown in FIG. 4, when the scan driver 2 receives a scan start signal in synchronism with a scan clock signal (e) during an address period, the shift register $\mathbf{2}_a$ sequentially captures a gate control signal (g) divided into one frame or into one sub-frame according to the scan clock signal (e), and the level shifter $\mathbf{2}_b$ supplies the gate control signal captured by the shift resister $\mathbf{2}_a$ to the pixel section 4A after it has been converted into a predetermined level.

FIG. 5 shows a part of the circuit arrangement of the pixel section 4A in FIG. 2. In FIG. 5, organic EL elements acting as a multiplicity of light-emitting elements are disposed in the pixel section 4A in a matrix shape as well as drive TFTs constituting drive circuit for driving the respective EL elements and control TFTs for controlling the drive TFTs are disposed in correspondence to the respective organic EL element.

That is, a multiplicity of data electrode lines 5-1, 5-2, 5-3 . . . , which are connected to the level shifter $\mathbf{1}_c$ in the data driver 1 described above, respectively, are disposed in a column direction, whereas a multiplicity of power supply lines 6-1, 6-2, 6-3, . . . are disposed also in the column direction in parallel with the data electrode lines. Further, a multiplicity of scan electrode lines 7-1, 7-2, 7-3, . . . , which are connected to level shifter $\mathbf{2}_b$ in the scan driver 2, are disposed in a row direction. Then, a control TFT, a drive TFT, a capacitor, and an organic EL element are provided in correspondence to a unit light-emitting pixel.

One unit light-emitting element will be described here. As shown in FIG. 5, the gate G of a control TFT ($Tr_1$) is connected to the scan electrode line 7-1 to which a scan signal (gate control signal) is supplied from a scan driver 2 so as to scan a row, whereas the source S of the control TFT is connected to the data electrode line 5-1 to which data is supplied from the data driver 1 in correspondence to the video signal. Further, the drain D of the control TFT is connected to the gate of a drive TFT ($Tr_2$) acting as a control electrode as well as to an end of a capacitor $C_1$.

Further, the drain D of the drive TFT is connected to the power supply line 6-1, and the other end of the capacitor $C_1$ is also connected to the power supply line 6-1. Further, the source D of the drive TFT acting as a drive electrode is connected to the anode electrode terminal of an organic EL elements $E_1$, and the cathode electrode terminal of the organic EL elements $E_1$ is grounded. The above arrangement is constructed similarly in correspondence to the respective EL elements disposed in the pixel section 4A.

The light emission of a unit pixel of the pixel section 4A, in which a plurality of the circuits described above are disposed in the column and row directions, is controlled in such a manner that when a turning-on voltage is supplied to the gate G of the control TFT ($Tr_1$), the control TFT flows a current, which corresponds to the voltage of the video signal data supplied to the source S, from the source S to the drain D thereof. The capacitor $C_1$ is charged with the current based on the voltage of the source S during a period in which the turning-on voltage is supplied to the gate G of the control TFT. Then, the charged voltage is supplied to the gate G of the drive transistor ($Tr_2$), and the drive TFT flows a current to the organic EL element $E_1$ based on the gate voltage thereof and on the voltage from the power supply line 6-1, thereby the organic EL elements $E_1$ is emitted.

In contrast, when the voltage supplied to the gate G of the control TFT ($Tr_1$) is turned off, the control TFT is placed in a so-called cut-off state, thereby the drain D of the control TFT is placed in an open state. Therefore, the voltage of the gate G of the drive TFT ($Tr_2$) is maintained by the charge accumulated in the capacitor $C_1$. Then, the current for driving the organic EL element E1 is maintained by the drive TFT until a scan is executed next, thereby the light emission of the organic EL element $E_1$ is also maintained. Note that it is possible for the drive transistor ($Tr_2$) to carry out operation similar to the operation described above without the provision of the capacitor $C_1$ because a gate input capacitance exists in the drive transistor ($Tr_2$).

FIG. 6 schematically shows an example when a partial display drive is executed making use of the active matrix type light-emitting display panel arranged as shown in FIGS. 2 and 5. According to the example of FIG. 6, a partial display state is shown in which the upper half portion of a display is arranged as a display region and the lower half portion thereof is arranged as anon-display region. FIGS. 7 to 9 show examples of respective signal waveforms that are utilized when the partial display as shown in FIG. 6 is executed.

FIG. 7 shows signal waveforms used in the scan driver 2, that is, a scan clock signal (e), a scan start signal (f), and a gate control signal (g). These signals are the same as those shown in and described with reference to FIG. 4. When the partial display is executed, the scan driver 2 scans all the scan electrode lines 7-1, 7-2, . . . disposed in the row direction. That is, the shift register $\mathbf{2}_a$ is sequentially shifted up in response to the scan clock signal (e) based on the scan start signal (f) shown in FIG. 7.

However, in this embodiment, the gate control signal (g) applied to the scan electrode lines is controlled to such a level as to apply the turning-on voltage to the gates (G) of the control TFTs connected to the respective scan electrode lines when the display region shown in FIG. 6 is scanned and to such a level (zero level) as to turning off the gates (G) of the control TFTs connected to the respective scan electrode lines when the non-display region is scanned. FIG. 7 shows this state.

In contrast, FIG. 8 shows a signal waveform used by the data driver 1 side when the partial display as shown in FIG. 6 is executed and shows the operating state of the data driver 1. Here, the start signal shown by (b) is output only when a partial display region is scanned. That is, when the display region shown in FIG. 6 is scanned, the start signal (b) is output at intervals of respective one horizontal period, thereby an image signal is displayed on the display region shown in FIG. 6. In this state, the data driver 1 is placed in an operating state similar to an ordinary operating state (shown as D.D. operation in FIG. 8).

Then, when the final line of the display region is scanned, a black display is prepared. When the organic EL elements are used as the light-emitting elements as in this embodiment, the non-display region employs normal black, and FIG. 9 shows a black data set means for setting black data when the final line of the display region is scanned. A clock signal (a), a start signal (b), a latch signal (c), and a video signal (d) shown in FIG. 9 are the same as those shown in and described with reference to FIG. 3. However, when the final line of the display region is scanned at the time the partial display is executed, the video signal during one horizontal period is entirely set to black data as shown in FIG. 9(*d*).

With this operation, only the black data is captured by the shift resister $\mathbf{1}_a$ in the data driver 1, and only the black data is latched by the latch circuit $\mathbf{1}_b$ based on the latch signal (c). Then, the operation of the data driver 1 is stopped from the next scan line, that is, from a scan line in the non-display region (shown as D.D. stop in FIGS. 8 and 9). In this case, since the scan driver 2 continues a scan similar to an ordinary scan as described above, the black data, which has been latched by the latch circuit $\mathbf{1}_b$ in the data driver 1, is sequentially written to respective non-display lines by the operation of the scan driver 2.

As a result, the respective capacitors $C_1$ disposed in the non-display region shown in FIG. 5 are set to a voltage level (non-charged state) by which the EL elements are set to a non-light-emission state, thereby all the EL elements in this region are placed in a non-light-emission state. Then, the lower half portion of this embodiment is arranged as the non-display region as shown in FIG. 6. Thus, when the final line in the non-display region is reached or when a dummy line, which is located apart from the final line and is not used for display, is reached, the data driver 1 resumes the operation as shown in FIG. 8 (shown as D.D. operation). With this operation, the display operation is executed again from the uppermost line of the display panel, and the partial display is executed as shown in FIG. 6.

As described above, the partial display, in which a display region is formed in a part of the display panel, can be realized in the arrangement shown in FIG. 2 by executing the drive operations shown in FIGS. 7 to 9. Then, when the partial display is realized, the scan driver continues the ordinary scan state as described above, and the black data is set to the shift resister (in other words, latch circuit) corresponding to the non-display section in the data driver so as to stop the operation of the data driver for the time corresponding to the non-display.

Therefore, according to the partial display drive means described above, no complicated control circuit is necessary in any of the data driver side and the shift driver side, thereby problems that a display region is sacrificed and that the opening ratio of a light-emitting element is reduced can be avoided. Further, low power consumption can be realized because the data driver that operates at a high speed is temporarily stopped when the non-display region is scanned.

Next, FIG. 10 shows a second embodiment of the drive unit of the active drive type display panel according to the present invention. The second embodiment is provided with a data driver 1, a first scan driver 2, and a second scan driver 3. Then, the data driver 1 and the first and second scan drivers 2 and 3 are mounted on, for example, the same glass substrate (not shown), which constitutes a display panel, together with a pixel section 4B likewise.

Then, a clock signal, a start signal, and a latch signal as well as a video signal, and the like are supplied to the data driver 1 from an external circuit, similarly to the first embodiment. Further, a scan clock signal, a scan start signal, and the like are supplied to the first scan driver 2 from the external circuit likewise. Further, the scan clock signal, the scan start signal, and the like are supplied also to the second scan driver 3 from the external circuit likewise. With this arrangement, the number of wirings between the data driver 1 disposed on, for example, the glass substrate constituting the display panel and the external circuit and the number of wirings between the first and second scan drivers 2 and 3 and the external circuit can be reduced as much as possible.

The data driver 1 described above includes a shift register $\mathbf{1}_a$, a latch circuit $\mathbf{1}_b$, and a level shifter $\mathbf{1}_c$ similarly to the example shown in FIG. 2 described above, and they achieve the same functions as the example shown in FIG. 2. Further, the second scan driver 3 includes a shift resister $\mathbf{3}_a$ and a level shifter $\mathbf{3}_b$ similarly to the example shown in FIG. 2 described above, and they achieve the same functions as the example shown in FIG. 2. Further, while the second scan driver 3 shown in FIG. 10 includes a shift resister $\mathbf{3}_a$ and a level shifter $\mathbf{3}_b$ in its hardware arrangement, they act to switch an erase TFT as described later.

FIG. 11 shows a part of the circuit arrangement of the pixel section 4B shown in FIG. 10. A multiplicity of data electrode lines 5-1, 5-2, 5-3, . . . disposed in a column direction are connected to the level shifter $\mathbf{1}_c$ in the data driver 1 and have the same function as the first embodiment described above. Further, a multiplicity of power supply lines 6-1, 6-2, 6-3, . . . are disposed in the column direction and also have the same function as the first embodiment.

Further, a multiplicity of data electrode lines 7-1, 7-2, 7-3, . . . are connected to the level shifter $\mathbf{2}_b$ in the first scan driver 2, respectively and also have the same function as the first embodiment described above. Accordingly, within the range of the arrangement described above, control TFTs ($Tr_1$), drive TFTs ($Tr_2$) and capacitors $C_1$ are connected and arranged to exhibit a similar action, thereby organic EL elements $E_1$ are driven for light emission.

In contrast, in the embodiment shown in FIG. 11, the drain D of an erase TFT ($Tr_3$) is connected to the node between the drain D of a control TFT ($Tr_1$) and a capacitor $C_1$ through a resistor $R_1$. The source S of the erase TFT is connected to a reference potential point as well as the gate G thereof is connected to an erase electrode line 8-1, and erase electrode lines 8-1, 8-2 . . . including the above erase electrode line 8-1 are connected to the level shifter $\mathbf{3}_b$ in the second scan driver 3, respectively.

According to the arrangement described above, the charge of the capacitors $C_1$ can be discharged by turning on the erase TFTs ($Tr_3$) in the midway of the period during which the light-emitting elements are lit, thereby it is possible to execute a gradation drive for controlling the lighting period of the light-emitting elements. That is, when the time gradation drive is executed in this type of the active matrix type display panel, an increase in the number of gradations requires an increase in a drive frequency in the arrangement in which the control TFTs ($Tr_1$) are combined with the drive TFTs ($Tr_2$) as shown in FIG. 5. Thus, it is known to use the erase TFTs ($Tr_3$) to realize the gradation drive without increasing the drive frequency.

The second embodiment according to the present invention effectively realizes the partial display making use of the erase TFTs ($Tr_3$) described above. Operation of the second embodiment will be described below.

FIG. 12 schematically shows an example when a partial display drive is executed in the second embodiment. According to the example shown in FIG. 12, a display region 1 is formed on the upper end side of a display and some non-display region is formed under the display region 1. Further, a display region 2 is formed under the non-display region and an approximately lower half portion under the display region 2 is arranged as a non-display region. FIGS. 13 and 14 show examples of respective signal waveforms utilized when the partial display as shown in FIG. 12 is realized.

First, when the partial display as shown in FIG. 12 is executed, a preparation frame is inserted. FIG. 13 shows the output timings of the respective signals when the preparation frame is inserted. That is, in the data driver 1 shown in FIG. 10, black data is captured as the video signal by the shift resister $\mathbf{1}_a$ as shown in 13(*d*) during one frame (or one sub-frame) and sequentially latched by the latch circuits $\mathbf{1}_b$. Then, the first scan driver 2 executes a scan using the scan clock signal (g) based on the scan start signal (f), thereby the black data is written to the capacitors constituting respective pixels over the one frame or the one sub-frame.

At the same time, partial display pattern data is transferred to the shift resister $\mathbf{3}_a$ in the second scan driver 3. The partial display pattern data is composed of the patterns of a display 1, a black display, a display 2, and a black display over the one frame (or the one sub-frame) as shown in FIG. 13(*i*) and arranged as a display pattern in a scan direction of the partial display shown in FIG. 12. The partial display pattern data shown in FIG. 13(*i*) is written to the shift resister $\mathbf{3}_a$ based on an erase gate clock signal (h) supplied to the second scan driver 3.

The drive operation of the one frame (or the one sub-frame) is executed by the insertion of the preparation frame. However, since the black data is set as the video signal and thus the light-emitting elements are not emitted as well as the period thereof is very short, the black data is not recognized by human eyes. On the completion of the insertion of the preparation frame, the supply of the erase gate clock signal (h) is stopped, thereby an erase gate stop state is achieved as shown in FIG. 13. With this operation, the pattern of the data signal (i) described above remains recorded in the shift resister 3*a* of the second scan driver 3 along the scan direction.

Subsequently, the partial display starts in the next frame (or sub-frame), and FIG. 14 shows the output timings of respective signals at this time. A pattern shown as (j) in FIG. 14 shows an erase gate output stage status, and the pattern (j) is the pattern that was written to the shift resister 3*a* by the data signal (i) when the preparation frame was executed. That is, in the regions which are shown as black displays, a potential level for turning of the erase TFTs ($Tr_3$) is output to the erase electrode lines 8-1, 8-2, . . . corresponding to these ranges through the level shifter $\mathbf{3}_b$. Accordingly, the charges of the capacitors $C_1$ are discharged at all times by turning on the erase TFTs ($Tr_3$) shown in FIG. 11 that correspond to these regions (non-display regions), thereby the light-emitting elements corresponding to the pixels in the regions are forcibly extinguished.

In the execution of the partial display, the operation of the data driver 1 shown in FIG. 10 is executed similarly to the first embodiment shown in FIG. 2. That is, when the display region 1 and the display region 2 are scanned, a video signal is shifted up to the shift resister $\mathbf{1}_a$ as well as operation is executed to cause the latch circuit $\mathbf{1}_b$ to latch the video signal. Then, when the non-display regions are scanned, the operation of the data driver 1 is stopped as shown in FIG. 12.

Further, also in the first scan driver 2, the shift resister $\mathbf{2}_a$ is sequentially shifted up by the scan clock signal (e) based on the scan start signal (f) shown in FIG. 14. Accordingly, an image is displayed on the display region 1 shown in FIG. 12 based on the vide signal (d) shown in FIG. 14.

Then, when black display regions in an erase gate output stage status (j) shown in FIG. 14 are scanned, the erase TFTs ($Tr_3$) described above are turned on. Thus, the data of the video signal (d) remaining in the latch circuit $\mathbf{1}_b$ in the display region 1 is ignored, and the light-emitting elements corresponding to the pixels of the non-display regions are placed in a forcibly extinguished state. Further, when the region of a display 2 is scanned, the image based on the video signal (d) is displayed on the display region 2 in FIG. 12.

Then, in this embodiment, the supply of the scan clock signal (e) is stopped as shown in FIG. 14 at the time the scan of the display region 2 has been completed. That is, when the supply of the scan clock signal (e) is stopped, data remains in the shift resister $\mathbf{2}_a$ of the first scan driver 2. However, since the erase gate output stage status (j) described above is displayed in black in the region under the display region 2, the light-emitting elements corresponding to the region are entirely extinguished.

According to the second embodiment described above, it is possible to obtain an operation/working-effect similar to the first embodiment described above as well as it is possible to stop the scan clock signal when the end of the display region of the one frame (one sub-frame) is reached as shown in FIG. 14(*e*). With this operation, lower power consumption can be realized. Moreover, according to this embodiment, the partial display described above can be realized without the addition of a circuit for resetting the shift resister in the scan driver as in the conventional example, thereby the problem of a decrease in the opening ratio can be avoided.

FIG. 15 shows a part of other circuit arrangement of the pixel section 4B shown in FIG. 10. In the arrangement shown in FIG. 15, circuits are connected approximately similarly to the example shown in FIG. 11, thereby an approximately similar operation/working-effect can be obtained. Accordingly, respective corresponding portions are denoted by the same reference numerals and the detailed description thereof is omitted. The arrangement of FIG. 15 is different from that shown in FIG. 11 in that the drain D and the source S of the erasing TFT ($Tr_3$) is connected to both the ends of the capacitor $C_1$.

That is, when a potential level for turning on the erasing TFT ($Tr_3$) is applied to the gate G thereof through the erase electrode lines 8-1, 8-2, . . . both the ends of the capacitor $C_1$ are short circuited by the erase TFT. Thus, the light-emitting elements corresponding to the pixels are forcibly extinguished. Therefore, the same operation/working effect can be obtained even if the arrangement shown in FIG. 15 is employed in place of the arrangement shown in FIG. 11.

Note that, in the second embodiment described above, power consumption is minimized because the stop period of the scan clock signal can be made long when the partial display region exists in the vicinity of the inlet position at which the shift resister on the scan side is shifted up. Accordingly, when the partial display region is spaced apart from the vicinity of the inlet position at which the shift resister on the scan side is shifted up, it is effective to dispose the inlet side where the shift resister is shifted up at an opposite position.

As apparent from the above description, according to the first embodiment employing the drive method of the present invention, low power consumption can be realized because the drive of the data driver operating at a high speed is stopped when the partial drive is executed.

Further, according to the second embodiment employing the drive method of the present invention, the drive of the first scan driver can be also stopped, in addition to the low power consumption realized by the first embodiment. With this operation, lower power consumption can be realized.

What is claimed is:

1. A drive unit of an active matrix type light-emitting display panel having a plurality of light-emitting elements which are disposed at a plurality of intersecting positions where a plurality of data electrode lines and a plurality of scan electrode lines intersect and the light emission of which light-emitting display panel is controlled by drive circuits, respectively, comprising:

a data driver for supplying image data to the respective data electrode lines, a scan driver for sequentially supplying a scan signal to the respective scan electrode lines, and control means for stopping the operation of the data driver when a partial display drive for controlling the light emission of a part of the effective light-emitting elements in the display panel is executed and when the scan driver scans a non-display region;

wherein said drive circuits include control transistors for transmitting image data supplied from the driver based on a scan signal supplied from the scan driver and drive transistors for supplying a drive current to the light-emitting elements based on the image data transmitted by the control transistors, at least one of said control transistors and at least one of said drive transistors being correspondent to each light-emitting element.

2. A drive unit of a light-emitting display panel according to claim 1, wherein the data driver and the scan driver are disposed on the same substrate constituting the display panel together with the respective drive circuits and the respective light-emitting elements corresponding thereto.

3. A drive unit of a light-emitting display panel according to claim 1, wherein the data driver includes a shift register for capturing serial image data as parallel image data by sequentially shifting up the serial image data based on a clock signal and a latch circuit for outputting pixel unit image data to the respective data electrode lines by latching the image data captured by the shift resister based on a latch signal.

4. A drive unit of a light-emitting display panel according to claim 1, wherein the scan driver includes a shift resister for outputting a scan signal to the respective scan electrode lines by sequentially shifting up it based on a clock signal.

5. A drive unit of a light-emitting display panel according to claim 4, comprising black data set means for capturing black data for controlling the light-emitting elements in a non-lighting state for at least one horizontal period when a scan is executed from a display region to a non-display region while the partial display drive is being executed to control the light emission of a part of the effective light-emitting elements in the display panel.

6. A drive method of an active matrix type light-emitting display panel having a plurality of light-emitting elements which are disposed at a plurality of intersecting positions where a plurality of data electrode lines and a plurality of scan electrode lines intersect and the light emission of which light-emitting display panel is controlled by drive circuits, respectively, a data driver for supplying image data to the respective data electrode lines, and a scan driver for sequentially supplying a scan signal to the respective scan electrode lines, the drive method executing:

a black data set step of capturing black data for controlling the light-emitting elements in a non-lighting state for at least one horizontal period when a scan is executed from a display region to a non-display region while a partial display drive is being executed to control the light emission of a part of the effective light-emitting elements in the display panel; and a step of scanning the non-display region with the scan signal from the scan driver in a black data set state that is set by the data driver.

7. A drive method of a light-emitting display panel according to claim 6, wherein the supply of a clock signal for driving the data driver is stopped while the step of scanning the non-display region is being executed.

8. A drive unit of an active matrix type light-emitting display panel having a plurality of light-emitting elements which are disposed at a plurality of intersecting positions where a plurality of data electrode lines, a plurality of scan electrode lines, and a plurality of erase electrode lines intersect and the light emission of which light-emitting display panel is controlled by drive circuits, respectively, characterized by comprising a data driver for supplying image data to the respective data electrode lines, a first scan driver for sequentially supplying a scan signal to the respective scan electrode lines, a second scan driver for supplying an erase signal to the erase electrode lines, and control means for stopping the operation of the data driver when a partial display drive for controlling the light emission of a part of the effective light-emitting elements in the display panel is executed and when the first scan driver scans a non-display region as well as for forcibly extinguishing the light-emitting elements corresponding to the non-display region by supplying an erase signal to the erase electrode lines corresponding to the non-display region from the second scan driver.

9. A drive unit of a light-emitting display panel according to claim 8, wherein the data driver, the first scan driver, and the second scan driver are disposed on the same substrate constituting the display panel together with the respective drive circuits and the respective light-emitting elements corresponding thereto.

10. A drive unit of a light-emitting display panel according to claim 8, wherein the drive circuits include control transistors for transmitting image data supplied from the data driver based on the scan signal supplied from the first scan driver, drive transistors for supplying a drive current to the light-emitting elements based on the image data transmitted by the control transistors, and erase transistors for disabling the operation of the drive transistors based on the erase signal supplied from the second scan driver.

11. A drive unit of a light-emitting display panel according to claim 8, wherein the second scan driver includes a shift resister to which erase control data corresponding to a partial display pattern is set based on a clock signal.

12. A drive unit of a light-emitting display panel according to claim 11, wherein the erase control data corresponding to the partial display pattern is set to the shift resister in the second scan driver during a preparation frame period.

13. A drive unit of a light-emitting display panel according to claim 12, wherein black data for controlling the light-emitting elements in a non-lighting state is captured by the shift resister in the data driver during the preparation frame period.

14. A drive unit of a light-emitting display panel according to claim 8, wherein the first scan driver stops its operation during a period until the starting point of a next one frame or one sub-frame is scanned after the first scan driver has scanned the final display region of one frame or one sub-frame.

15. A drive unit of a light-emitting display panel according to any of claims 1 to 5 or any of claims 8 to 14, wherein the light-emitting elements comprise organic EL elements using an organic compound in the light emitting layers thereof.

16. A drive method of an active matrix type light-emitting display panel having a plurality of light-emitting elements which are disposed at a plurality of intersecting positions where a plurality of data electrode lines, a plurality of scan electrode lines, and a plurality of erase electrode lines intersect and the light emission of which light-emitting display panel is controlled by drive circuits, respectively, a data driver for supplying image data to the respective data electrode lines, a first scan driver for supplying a scan signal to the respective scan electrode lines, and a second scan driver for supplying an erase signal based on a partial display pattern to the respective erase electrode lines, the drive method executing:

a step of setting the erase data based on the partial display pattern to the second scan driver;

a step of executing a partial display based on the image data supplied from the data driver when a display region is scanned with the scan signal from the first scan driver; and a step of forcibly extinguishing the light-emitting elements corresponding to a non-display region based on the erase data set to the second scan driver when a scan is executed from the display region to the non-display region.

17. A drive method of a light-emitting display panel according to claim 16, wherein the drive of the data driver is stopped as well as the first scan driver stops its operation during a period until the starting point of a next one frame or one sub-frame is scanned after the first scan driver has scanned the final display region of one frame or one sub-frame in the state in which the non-scan region is scanned.

18. A drive method of a light-emitting display panel according to claim 16, wherein a step of capturing black data for controlling the light-emitting elements in a non-lighting state by the shift resister in the data driver is executed just before a step of setting the erase data based on the partial display pattern to the second scan driver is executed.

19. A drive unit of an active matrix type light-emitting display panel having a plurality of light-emitting elements which are disposed at a plurality of intersecting positions where a plurality of data electrode lines and a plurality of scan electrode lines intersect and the light emission of which light-emitting display panel is controlled by drive circuits, respectively, comprising:

a data driver for supplying image data to the respective data electrode lines;

a scan driver for sequentially supplying a scan signal to the respective scan electrode lines; and control means for stopping the operation of the data driver when a partial display drive for controlling the light emission of a part of the effective light-emitting elements in the display panel is executed and when the scan driver scans a non-display region;

wherein the data driver and the scan driver are disposed on the same substrate constituting the display panel together with the respective drive circuits and the respective light-emitting elements corresponding thereto, and wherein the drive circuits include control transistors for transmitting image data supplied from the data driver based on a scan signal supplied from the scan driver and drive transistors for supplying a drive current to the light-emitting elements based on the image data transmitted by the control transistors.

20. A drive unit of an active matrix type light-emitting display panel having a plurality of light-emitting elements which are disposed at a plurality of intersecting positions where a plurality of data electrode lines and a plurality of scan electrode lines intersect and the light emission of which light-emitting display panel is controlled by drive circuits, respectively, comprising:

a data driver for supplying image data to the respective data electrode lines;

a scan driver for sequentially supplying a scan signal to the respective scan electrode lines;

control means for stopping the operation of the data driver when a partial display drive for controlling the light emission of a part of the effective light-emitting elements in the display panel is executed and when the scan driver scans a non-display region; and black data set means for capturing black data for controlling the light-emitting elements in a non-lighting state for at least one horizontal period when a scan is executed from a display region to a non-display region while the partial display drive is being executed to control the light emission of a part of the effective light-emitting elements in the display panel;

wherein the scan driver includes a shift resister for outputting a scan signal to the respective scan electrode lines by sequentially shifting up it based on a clock signal.

* * * * *